US011490185B2

(12) United States Patent
Niu et al.

(10) Patent No.: US 11,490,185 B2
(45) Date of Patent: Nov. 1, 2022

(54) ELECTRONIC DEVICE

(71) Applicant: Lenovo (Singapore) Pte. Ltd., Singapore (SG)

(72) Inventors: Wenjin Niu, Kanagawa (JP); Jun Iwasaki, Kanagawa (JP); Toshikazu Horino, Kanagawa (JP); Toshinari Sumikawa, Kanagawa (JP); Shigehiro Horiuchi, Kanagawa (JP); Takehito Yamauchi, Kanagawa (JP); Yalu Liu, Kanagawa (JP); Keita Ishikawa, Kanagawa (JP)

(73) Assignee: Lenovo (Singapore) Pte. Ltd., Singapore (SG)

( * ) Notice: Subject to any disclaimer, the term of this patent is extended or adjusted under 35 U.S.C. 154(b) by 0 days.

(21) Appl. No.: 17/388,326

(22) Filed: Jul. 29, 2021

(65) Prior Publication Data

US 2022/0174386 A1 Jun. 2, 2022

(30) Foreign Application Priority Data

Dec. 1, 2020 (JP) ..... JP2020-199385

(51) Int. Cl.
*H04R 1/04* (2006.01)
*H04R 19/04* (2006.01)

(52) U.S. Cl.
CPC ..... *H04R 1/04* (2013.01); *H04R 19/04* (2013.01)

(58) Field of Classification Search
CPC ..... H04R 1/02; H04R 1/025; H04R 1/026; H04R 2499/15; H04R 19/005
See application file for complete search history.

(56) References Cited

U.S. PATENT DOCUMENTS

2015/0181346 A1* 6/2015 Jingming ..... H04R 1/342 381/114

FOREIGN PATENT DOCUMENTS

JP 2013165409 A 8/2013

* cited by examiner

*Primary Examiner* — Mark Fischer
(74) *Attorney, Agent, or Firm* — Osha Bergman Watanabe & Burton LLP

(57) ABSTRACT

An electronic device includes a chassis, a microphone hole penetrating an outer wall of the chassis, and a microphone module that faces the microphone hole. The microphone module has a microphone that obtains sound information outside the chassis through the microphone hole, a flexible substrate laminated on a back surface of the microphone, a metallic plate laminated on a back surface of the flexible substrate, and a sound hole opened in the back surface of the microphone and penetrating the flexible substrate and the metallic plate. The electronic device further includes a double-sided tape fastened to a first region, surrounding the sound hole, of a back surface of the metallic plate, and to an inner surface of the chassis, and that fixes the microphone module to the chassis, and a conductive member that electrically connects the second region of the metallic plate and the inner surface of the chassis.

10 Claims, 14 Drawing Sheets

ELECTRONIC DEVICE

CROSS-REFERENCE TO RELATED APPLICATIONS

This application claims priority to Japanese Patent Application No. 2020-199385 filed Dec. 1, 2020, the contents of which are hereby incorporated herein by reference in their entirety.

BACKGROUND

Technical Field

The present invention relates to an electronic device including a microphone module.

Related Art

An electronic device like a laptop PC includes a microphone module (for example, refer to Japanese Unexamined Patent Application Publication No. 2013-165409).

As described in the above-described Japanese Unexamined Patent Application Publication No. 2013-165409, it is common that a conventional microphone module is fixed to a chassis using a screw.

However, it may be difficult to secure a space for fastening a screw since the electronic device like a laptop PC is rapidly becoming thinner and a width of a bezel is rapidly becoming reduced.

Then, the microphone module can be fixed to the chassis by a double-sided tape. However, a double-sided tape that has a strong adhesive power enough to ensure high airtightness generally does not have electrical conductivity. Thus, in the method of fixing the microphone module by the double-sided tape, securing frame ground becomes an issue.

SUMMARY

One or more embodiments provide an electronic device in which a microphone can be installed even in a reduced space.

An electronic device according to one or more embodiments is an electronic device including a chassis, a microphone hole penetrating an outer wall of the chassis and communicating the inside and outside of the chassis, and a microphone module provided in the chassis and disposed so as to face the microphone hole, in which the microphone module has a microphone configured to obtain sound information outside the chassis through the microphone hole, a flexible substrate laminated on a back surface of the microphone and mounted with the microphone, a metallic plate laminated on a back surface of the flexible substrate, and a sound hole opened in the back surface of the microphone and penetrating the flexible substrate and the metallic plate, and the electronic device further includes a double-sided tape fastened to a first region, surrounding the sound hole, of a back surface of the metallic plate, and to an inner surface of the chassis, and configured to fix the microphone module to the chassis, and a conductive member configured to electrically connect a second region, except the first region, of the metallic plate and the inner surface of the chassis.

An electronic device according to one or more embodiments includes a chassis, a microphone hole penetrating an outer wall of the chassis and communicating the inside and outside of the chassis, and a microphone module provided in the chassis and disposed so as to face the microphone hole, in which the microphone module has a microphone configured to obtain sound information outside the chassis through the microphone hole, a flexible substrate laminated on a back surface of the microphone and mounted with the microphone, a metallic plate laminated on a back surface of the flexible substrate, and a sound hole opened in the back surface of the microphone and penetrating the flexible substrate and the metallic plate, and the electronic device further includes a double-sided tape fastened to a first region, surrounding the sound hole, of a back surface of the metallic plate, and to an inner surface of the chassis, and configured to fix the microphone module to the chassis, and a conductive member installed between a second region, except the first region, of the back surface of the metallic plate, and the inner surface of the chassis, and configured to electrically connect the second region and the inner surface of the chassis.

According to one or more embodiments, it becomes possible to install a microphone even in a reduced space.

DETAILED DESCRIPTION

Hereinafter, embodiments of the present invention are described in detail with reference to the attached drawings.

Figure 1:
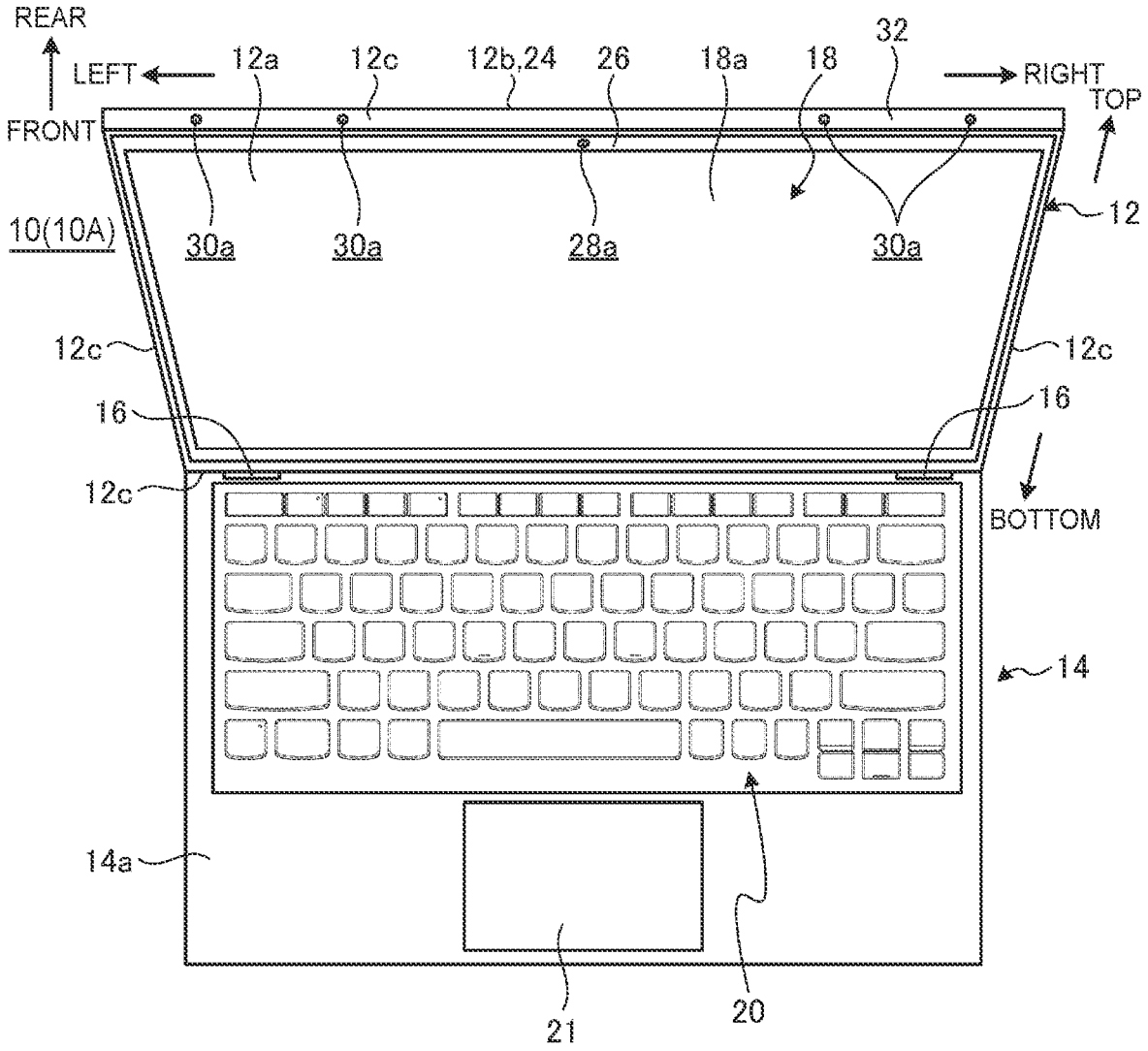
FIG. 1 is a schematic overhead perspective view of an electronic device according to a first embodiment.

FIG. 1 is a schematic overhead perspective view of an electronic device 10 according to a first embodiment. As illustrated in FIG. 1, the electronic device 10 is a clamshell type laptop PC in which a first chassis 12 and a second chassis 14 are relatively rotatably connected by a hinge 16. The first chassis 12 is a display chassis that is equipped with a display 18. The second chassis 14 is a chassis that is equipped with input devices such as a keyboard 20 and a touchpad 21 and a motherboard etc. The electronic device according to one or more embodiments may be, for example, a single display device, a tablet PC, a mobile phone, a smartphone, or a portable game console etc., other than the laptop PC.

Hereinafter, the electronic device 10 is described, based on a state where surface normal directions of the chassis 12 and 14 are orthogonal (at 90 degrees) to each other, with the direction toward a user using the keyboard 20 while visually recognizing a display surface 18*a* of the display 18 being referred to as front, the direction away from the user being referred to as rear, the width direction of the electronic device 10 being referred to as right and left, the top-and-bottom direction thereof being referred to as top and bottom. These respective directions are for convenience of description and actual directions vary accordingly depending on a posture of the electronic device 10 or an angle between the chassis 12 and 14.

The second chassis 14 is a flat box body. Various electronic components such as a motherboard mounted with a CPU etc., a battery device, a memory, and an antenna device, are stored within the second chassis 14. The keyboard 20 and the touchpad 21 are mounted so as to face a top surface 14*a* of the second chassis 14.

The first chassis 12 is a flat box body that is thinner than the second chassis 14. The display 18 has a display surface 18*a* that faces a front surface 12*a* of the first chassis 12. The first chassis 12 has a cover member 24 that forms a rear surface 12*b*, and a bezel member 26 that forms a peripheral edge part of the front surface 12*a*. Top, bottom, right, and left side surfaces 12*c* of the first chassis 12 are formed by vertical walls 32 raised from four peripheral edge parts of the cover member 24 (refer to FIG. 2). The cover member 24 may be formed in a plate shape that forms only the rear surface 12*b*, and the side surfaces 12*c* may be formed on a frame-shaped frame as a separate part. A bottom edge part of the first chassis 12 in FIG. 1 is relatively rotatably connected to a rear edge part of the second chassis 14 through the hinge 16.

Figure 2:
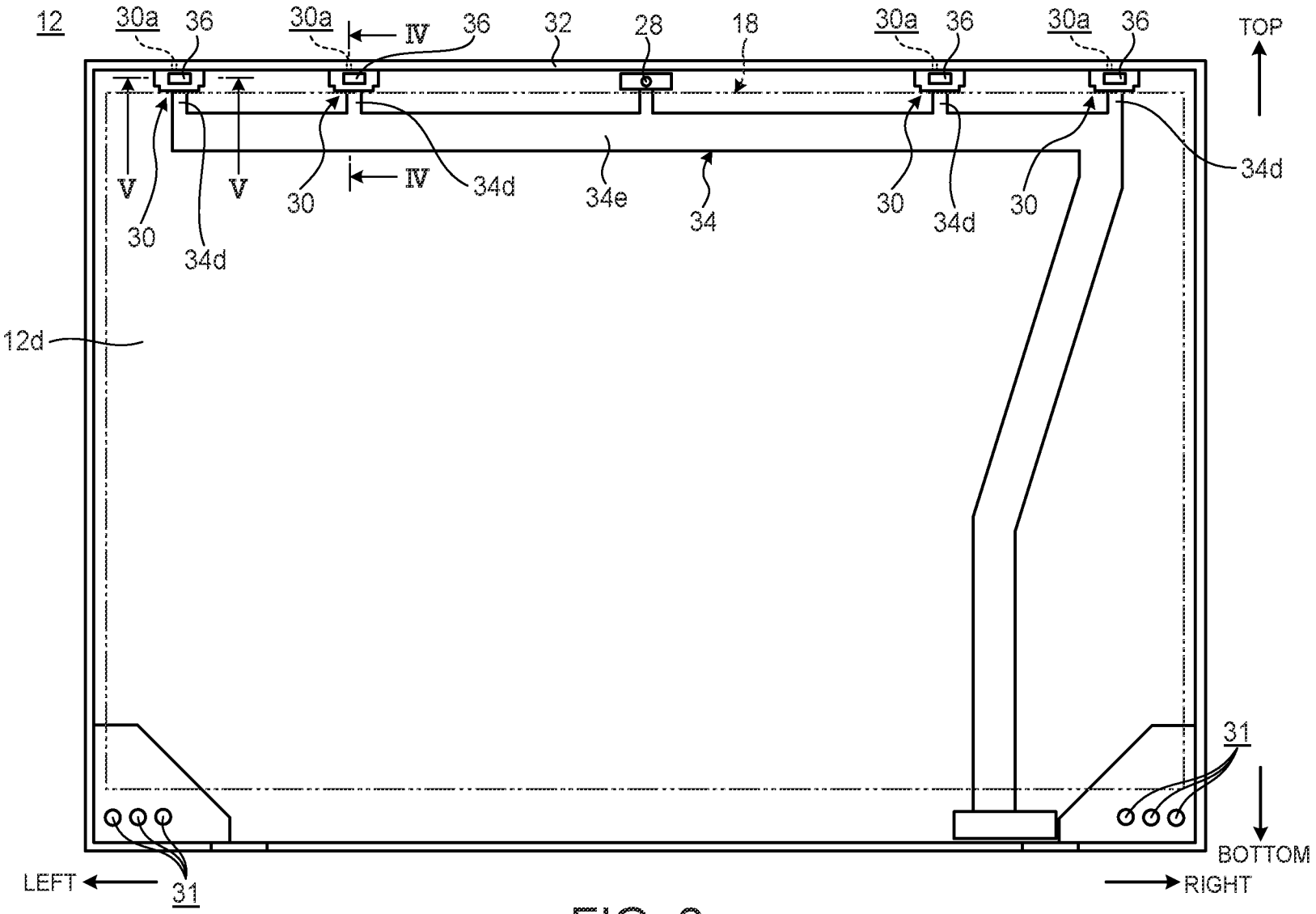
FIG. 2 is a schematic plan view of a first chassis as viewed from a front surface side.

FIG. 2 is a schematic plan view of the first chassis as viewed from the front surface 12*a* side. In FIG. 2, illustration of the bezel member 26 is omitted and only an outline of the display 18 is illustrated by a dashed-two dotted line. That is, in FIG. 2, an inner surface 12*d* (back side of the rear surface 12*b*) of the first chassis 12, and each component installed on this inner surface 12*d* are illustrated.

As illustrated in FIG. 2, a top edge part of the first chassis 12 is provided with a camera 28 and a plurality of microphone modules 30. A reference symbol 31 in FIG. 2 denotes screw holes for fixing the hinge 16, and the holes are provided at right and left corners of the bottom edge part.

The camera 28 is attached to the inner surface 12*d* of the first chassis 12. The camera 28 faces outside of the first chassis 12 through a camera hole 28*a* (refer to FIG. 1) formed on the front surface 12*a* of the first chassis 12. The camera hole 28*a* is formed at substantially the center in the right-and-left direction of the bezel member 26 above the display 18.

The microphone module 30 is attached to the inner surface 12*d* of the first chassis 12. For example, four microphone modules 30 are installed so as to be arranged right and left. Each microphone module 30 obtains sound information outside the first chassis 12 through a microphone hole 30*a* formed on the side surface 12*c* on a top side of the first chassis 12 (refer to FIG. 1). The microphone hole 30*a* is a fine hole that penetrates an outer wall of the first chassis 12. Specifically, the microphone hole 30*a* penetrates from the inner surface 12*d* to the vertical wall 32 that forms the side surface 12*c* on the top side of the first chassis 12 (refer to FIG. 4). The microphone hole 30*a* may have a shape of penetrating from the inner surface 12*d* of the first chassis 12 to the rear surface 12*b* in the front-and-rear direction.

Next, a configuration of the microphone module 30 is described.

Figure 3A:
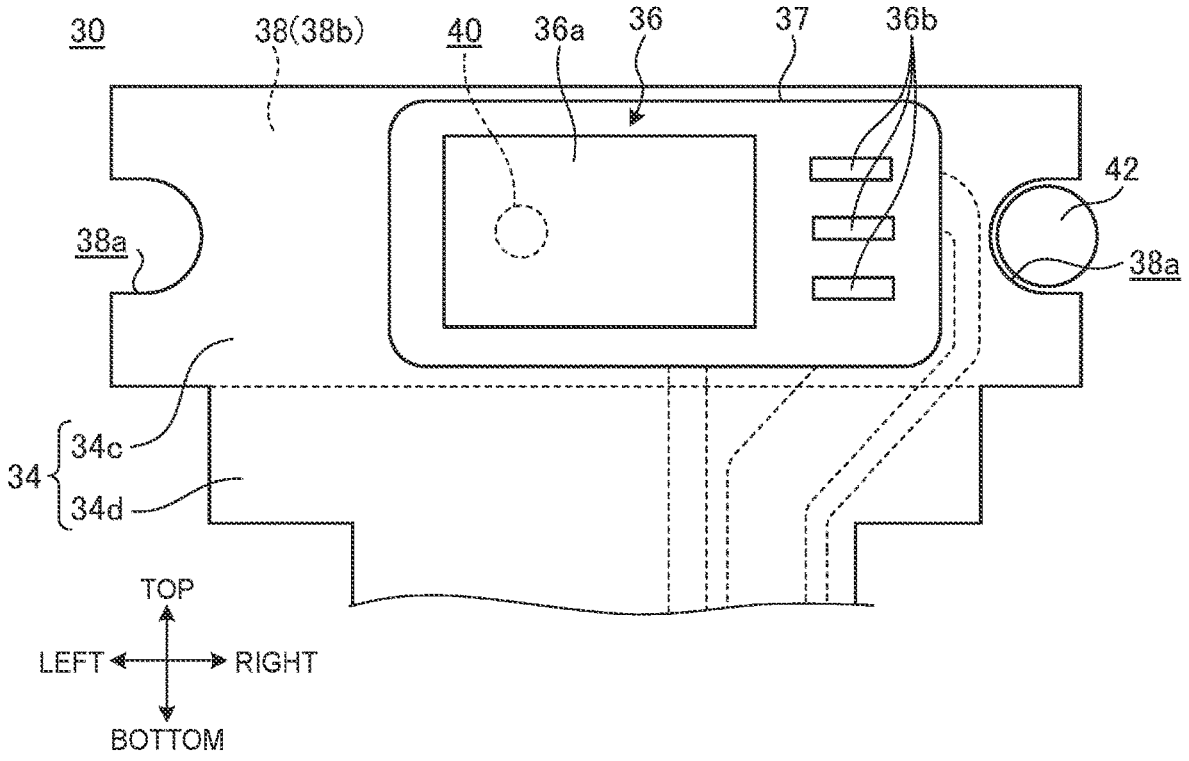
FIG. 3A is a schematic plan view of a microphone module as viewed from the front surface side.
Figure 3B:
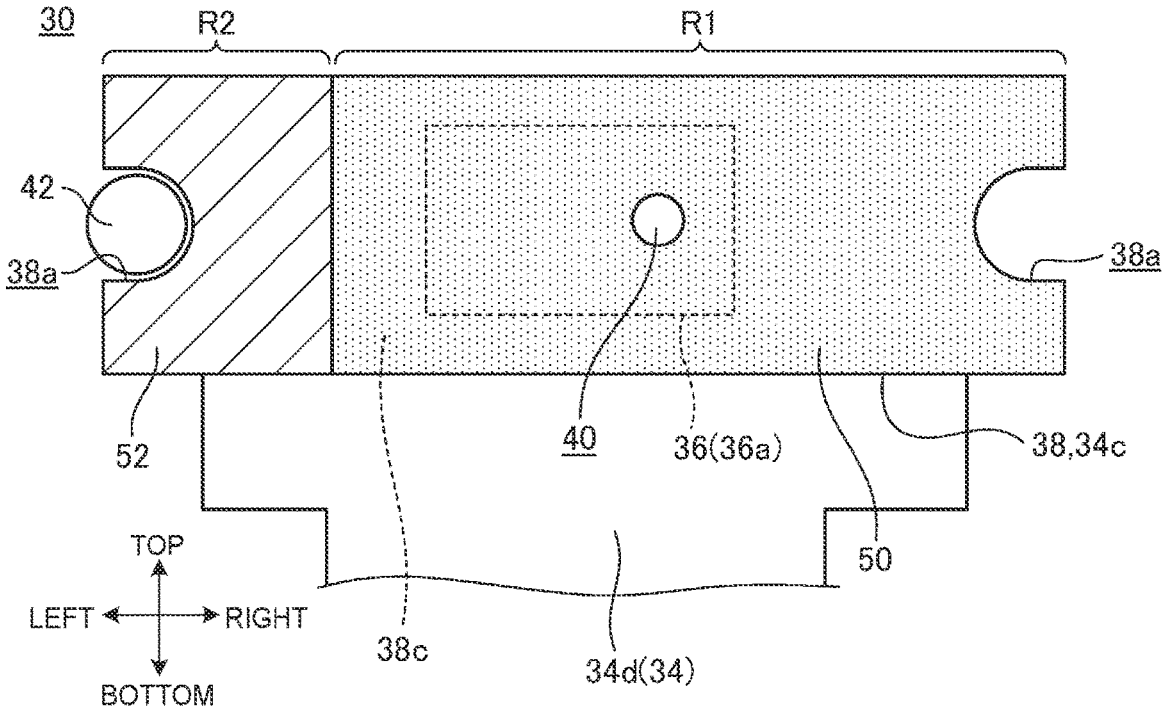
FIG. 3B is a schematic bottom view of the microphone module illustrated in FIG. 3A as viewed from a rear surface side.
Figure 4:
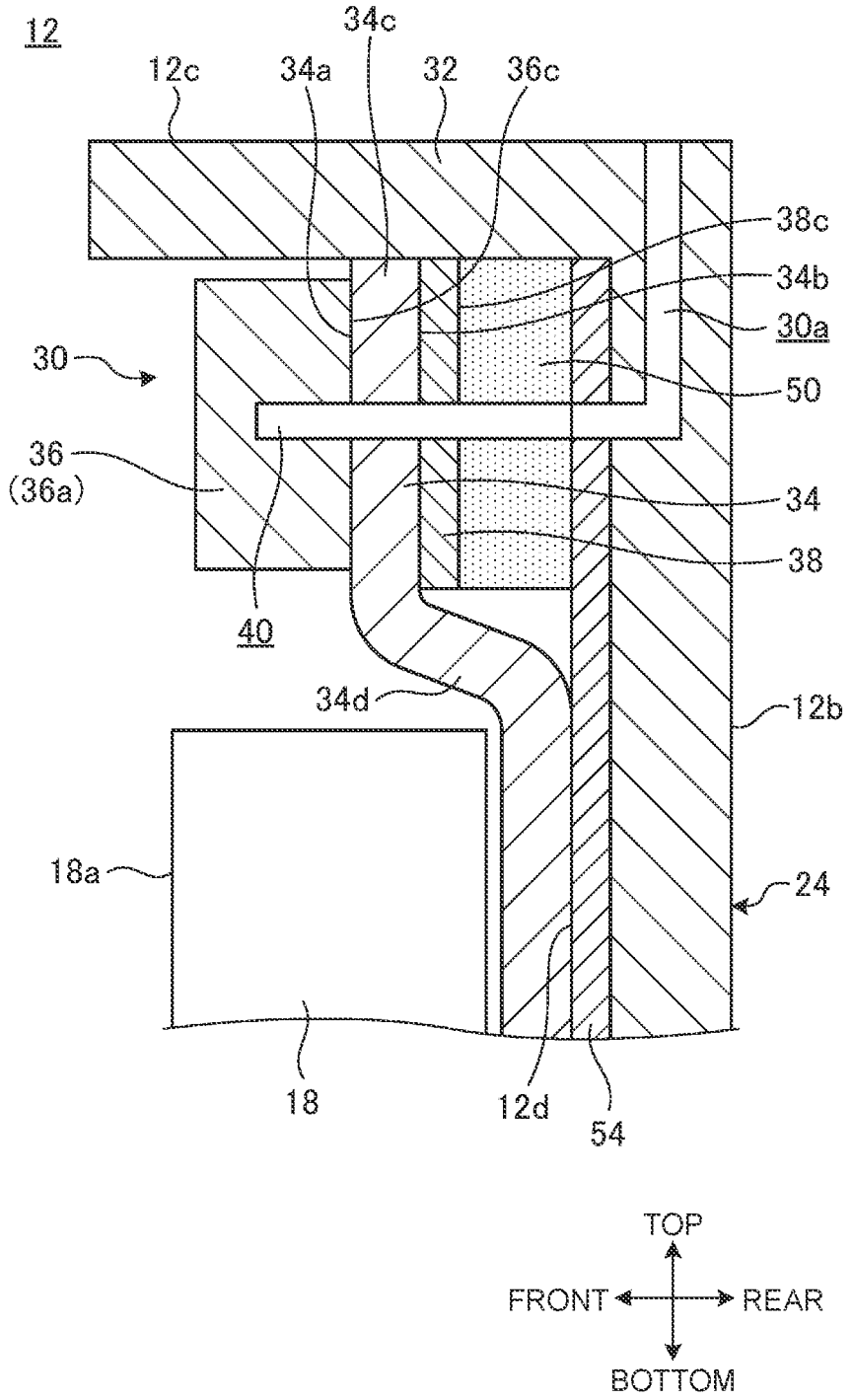
FIG. 4 is a schematic cross-sectional view along a IV-IV line in FIG. 2.

FIG. 3A is a schematic plan view of the microphone module 30 as viewed from the front surface 12*a* side. FIG. 3B is a schematic bottom view of the microphone module 30 as illustrated in FIG. 3A as viewed from the rear surface 12*b* side. FIG. 4 is a schematic cross-sectional view along a IV-IV line in FIG. 2. FIG. 5 is a schematic cross-sectional view along a V-V line in FIG. 2.

As illustrated in FIG. 2, for example, the microphone modules 30 arranged right and left are used in pairs, and a left pair of two microphone modules 30 is disposed on the left of the camera 28 and a right pair of two microphone modules 30 is disposed on the right of the camera 28. Each microphone module 30 is disposed at a position above a top edge part of the display 18 and covered by the bezel member 26. For example, only a pair of two microphone modules 30 may be installed.

Each microphone module 30 is mounted on a flexible substrate 34 (FPC: Flexible Printed Circuits). The flexible substrate 34 extends between the inner surface 12*d* of the first chassis 12 and a back surface of the display 18 from the top to the bottom, and is connected to the motherboard etc. in the second chassis 14 from the bottom edge part of the first chassis 12 through the rear edge part of the second chassis 14. Each pair of the microphone modules 30 may be mounted on a different flexible substrate, for example. In addition, each microphone module 30 may be mounted on a separate flexible substrate. In the first embodiment, the camera 28 is also connected to the flexible substrate 34.

As illustrated in FIG. 3A to FIG. 5A, each microphone module 30 includes a microphone 36, the flexible substrate 34, a metallic plate 38, and a sound hole 40.

Figure 5A:
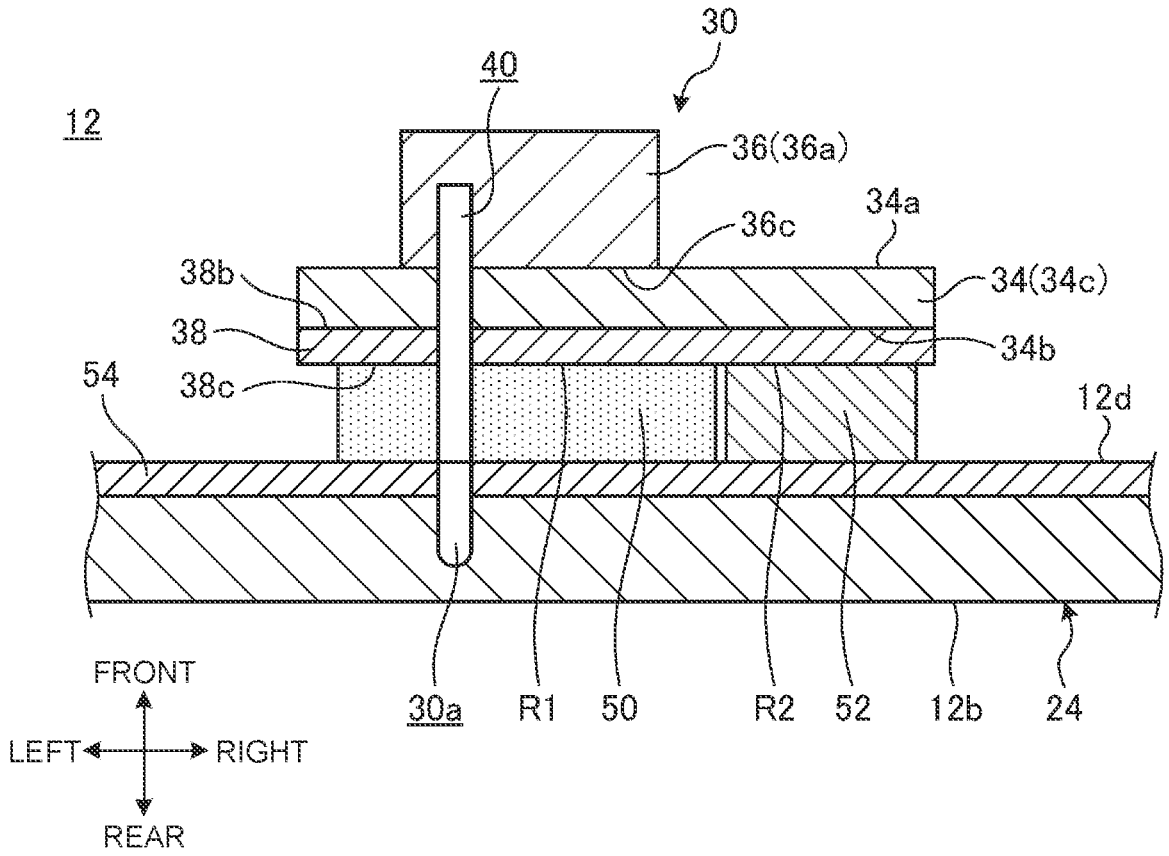
FIG. 5A is a schematic cross-sectional view along a V-V line in FIG. 2.

The microphone 36 is, for example, a MEMS microphone in which a MEMS chip 36*a* having a vibrating membrane and IC chips 36*b* are shielded by a polymer cover 37. The sound hole 40 is opened in a back surface 36*c* of the microphone 36 (MEMS chip 36*a*). The flexible substrate 34 is laminated on the back surface 36*c* of the microphone 36. That is, a front surface 34*a* of the flexible substrate 34 becomes a surface on which the microphone 36 is mounted. It is to be noted that, in each drawing following FIG. 5A, illustration of the IC chips 36*b* and the MEMS chip 36*a* is omitted.

The metallic plate 38 is a thin plate that is made of a conductive metal such as stainless steel (SUS), aluminum, and copper. The metallic plate 38 is laminated on a back surface 34*b* of the flexible substrate 34. The metallic plate has a width dimension in the top-and-bottom direction slightly larger than the microphone 36 and a width dimension in the right-and-left direction larger to a certain extent than the microphone 36 and is formed into a substantially rectangular shape as a whole. Arc-shaped cutout parts 38*a* are formed at both right and left ends of the metallic plate 38. The cutout part 38*a* functions as a positioning part into which a positioning pin 42 raised from the inner surface 12*d* is fitted. The cutout part 38*a* and the positioning pin 42 may be omitted.

The flexible substrate 34 has a microphone-mounting part 34*c* that covers substantially the entire surface of a front surface 38*b* of the metallic plate 38 and a branch line part 34*d* that extends from the microphone-mounting part 34*c* toward the bottom. The branch line parts 34*d* of the respective microphone modules 30 gather at a main line part 34*e* to be routed to the second chassis 14 (refer to FIG. 2).

The sound hole 40 is opened in the back surface 36*c* of the microphone 36 (MEMS chip 36*a*) and penetrates the flexible substrate 34 and the metallic plate 38. The sound hole 40 further penetrates a double-sided tape 50 as mentioned below and is communication with the microphone hole 30*a* of the first chassis 12. The sound hole 40 is a sound input part for the microphone module 30 and is communication with a vibrating membrane within the microphone 36.

Next, a structure for attaching the microphone module 30 to the first chassis 12 is described.

As illustrated in FIG. 4 and FIG. 5A, each microphone module 30 is attached to the first chassis 12 using the double-sided tape 50 and a conductive double-sided tape 52.

Figure 6:
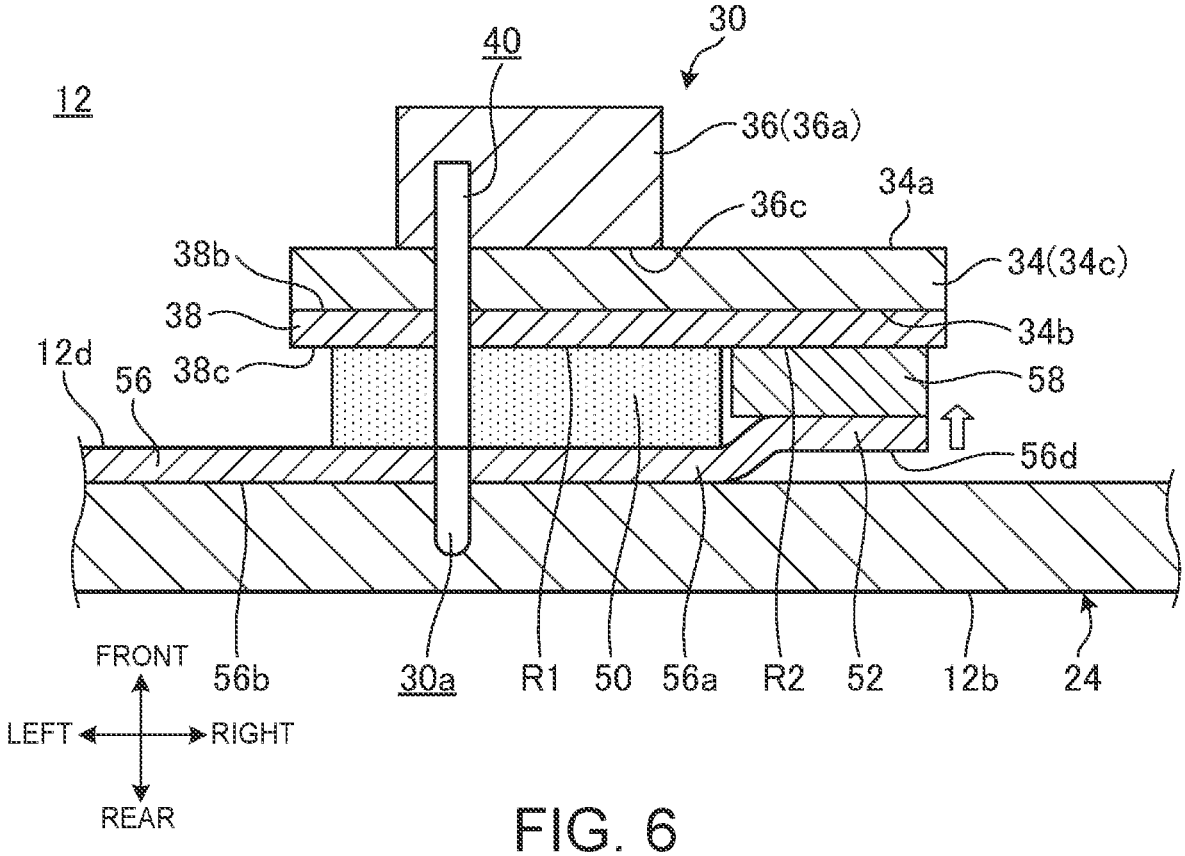
FIG. 6 is a schematic cross-sectional view in a state where the microphone module is attached to the first chassis using a conductive member according to a first variation.

It is to be noted that in the first chassis 12 as illustrated in FIG. 4 and FIG. 5A, a metal-deposited layer (Spattering Surface) 54 is formed on an inner surface of the cover member 24, and a surface of this metal-deposited layer 54 forms the inner surface 12*d* of the first chassis 12. The microphone module 30 is therefore fixed to the surface of the metal-deposited layer 54. If the cover member 24 is made of sufficiently conductive metal etc., the metal-deposited layer 54 may be omitted. In place of the metal-deposited layer 54, a metallic sheet 56 etc. as illustrated in FIG. 6 may be used.

The double-sided tape 50 is an adhesive member for fixing the microphone module 30 to the inner surface 12*d*. The double-sided tape 50 fixes the back surface 38*c* of the metallic plate 38 and the inner surface 12*d* of the first chassis 12. The sound hole 40 also penetrates the double-sided tape 50. In other words, a through-hole in communication with the sound hole 40 is formed in the double-sided tape 50.

As illustrated in FIG. 3B and FIG. 5A, the double-sided tape 50 is provided at a partial region (first region R1), surrounding the sound hole 40, of the back surface 38*c* of the metallic plate 38. The first region R1 is a region that occupies, for example, about 80% of an area of the back surface 38*c*, and must completely surround the sound hole 40.

The double-sided tape 50 must strongly fix the microphone module 30 to the inner surface 12*d* and ensure air-tightness of the sound hole 40. Currently, for the double-sided tape 50, only ones made of insulating materials are available on the market. The double-sided tape 50 according to the first embodiment may include, for example, VHB tape (registered trademark) from 3M Company.

The conductive double-sided tape 52 is a conductive member for grounding (frame-grounding) the microphone module 30 to the first chassis 12. The conductive double-sided tape 52 is fastened to the back surface 38*c* of the metallic plate 38 and the inner surface 12*d* of the first chassis 12.

As illustrated in FIG. 3B and FIG. 5A, the conductive double-sided tape 52 is provided at a region (second region R2), except the first region R1, of the back surface 38*c* of the metallic plate 38. The second region R2 is a region that occupies, for example, about 20% of the area of the back surface 38*c*, and must not overlap the sound hole 40.

The conductive double-sided tape 52 must electrically connect the metallic plate 38 and the metal-deposited layer 54. The conductive double-sided tape 52 according to the first embodiment has a configuration, for example, in which adhesive layers filled with conductive fillers (for example, nickel fillers) are provided on both sides of a conductive base material (fabric).

Figure 5B:
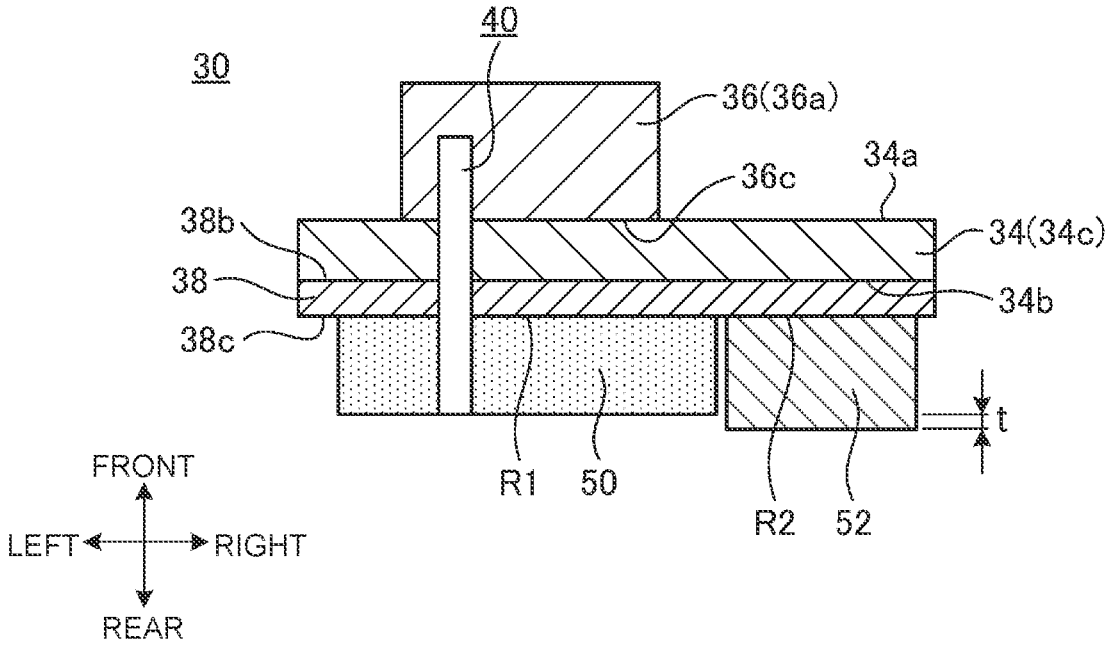
FIG. 5B is a schematic cross-sectional view in a state before the microphone module is fixed to the first chassis.

For such a conductive double-sided tape 52, when the adhesive layers on both sides of the base material are not in a state of being sufficiently compressed, the conductive fillers filled in the respective adhesive layers are not sufficiently brought into contact with each other and a desired electrical conductivity cannot be obtained in the thickness direction. Then, as illustrated in FIG. 5B, the conductive double-sided tape 52 having a thickness a little greater than that of the double-sided tape 50 in a state before the microphone module 30 is fixed to the first chassis 12, is used. That is, in a state of no load, the conductive double-sided tape 52 is thicker by a thickness t in FIG. 5B than the double-sided tape 50. In a state where the microphone module 30 is attached to the first chassis 12, the conductive double-sided tape 52 is installed in a compressed state between the second region R2 of the metallic plate 38 and the inner surface 12*d* of the first chassis 12.

Therefore, when the microphone module 30 is fixed to the inner surface 12*d* of the first chassis 12, it presses the double-sided tape 50 and the conductive double-sided tape 52 against the surface of the metal-deposited layer 54 (inner surface 12*d*) while compressing them. Then, when the double-sided tape 50 is sufficiently compressed and the microphone module 30 is fixed to the inner surface 12*d*, the conductive double-sided tape 52 is compressed more by at least the thickness t. As a result, the conductive fillers of the respective adhesive layers are sufficiently brought into contact with each other, and the conductive double-sided tape 52 electrically connects the metallic plate 38 and the first chassis 12 with a desired electrical conductivity. The thickness of the conductive double-sided tape 52 may be set to, for example, more than 100% and less than or equal to 110% of the thickness of the double-sided tape. This is because too great thickness t would instead cause a decrease in adhesive power of the double-sided tape 50. It is to be noted that since a thickness ratio of the conductive double-sided tape 52 to the double-sided tape 50 also differs depending on the thickness of the double-sided tape 50 or a material of the conductive filler, it can be set to an optimum value according to each specification.

FIG. 6 is a schematic cross-sectional view in a state where the microphone module 30 is attached to the first chassis 12 using a conductive member (conductive double-sided tape 58) according to a first variation. In a configuration of the microphone module 30 and its peripheral part as illustrated in FIG. 6, an element that exhibits a function and an effect the same as or similar to the configuration of the microphone module 30 and its peripheral part as illustrated in FIG. 1 to FIG. 5B is followed by the same reference symbol and its detailed description is omitted, and the same applies to each configuration example in FIG. 7 to FIG. 8B.

The configuration example as illustrated in FIG. 6 is different from that as illustrated in FIG. 5A in using the conductive double-sided tape 58 and a metallic sheet 56, instead of the conductive double-sided tape 52 and the metal-deposited layer 54.

The conductive double-sided tape 58 may be a double-sided tape that has a characteristic the same as or similar to the above-described conductive double-sided tape 52 except that a thickness relationship relative to the double-sided tape 50 is different. As is clear from FIG. 6, the thickness of the conductive double-sided tape 58 is smaller than that of the double-sided tape 50 in a state of no load before the microphone module 30 is fixed to the first chassis 12.

The metallic sheet 56 is stuck onto the inner surface of the cover member 24 and its surface forms the inner surface 12*d* of the first chassis 12. The microphone module 30 is therefore fixed to a surface of the metallic sheet 56. The metallic sheet 56 is a thin sheet that is made of metal such as aluminum and copper.

A portion 56*a* (portion overlapping the first region R1 in plan view) to which the double-sided tape 50 is fixed, of the metallic sheet 56, has a back surface 56*b* that is stuck to the inner surface of the cover member 24 with a sticky agent or an adhesive. A portion 56*c* (portion overlapping the second region R2 in plan view) that overlaps the conductive double-sided tape 58, of the metallic sheet 56, has a non-adhesive region 56*d* where no adhesive or sticky agent is provided on the back surface 56*b*, and the non-adhesive region 56*d* is not stuck onto the inner surface 12*d*.

Therefore, when the microphone module 30 of the configuration example as illustrated in FIG. 6 is fixed to the inner surface 12*d* of the first chassis 12, it presses the double-sided tape 50 and the conductive double-sided tape 58 against the surface of the metallic sheet 56 (inner surface 12*d*) while compressing them. Then, the double-sided tape 50 is sufficiently compressed, and at the same time, the conductive double-sided tape 58 is also pressed against the portion 56*c* of the metallic sheet 56 while being compressed. Next, when the pressing force of the microphone module 30 is released, the microphone module 30 is lifted in a direction of being separated from the inner surface 12*d* by a repulsive force of the double-sided tape 50. At this time, the portion 56*c* of the metallic sheet 56 has the non-adhesive region 56*d*. Thus, the portion 56*c* of the metallic sheet 56 is lifted together with the conductive double-sided tape 58 and separated from the inner surface of the cover member 24. With this, the portion 56*c* of the metallic sheet 56 is integrated with the conductive double-sided tape 58 and is never pulled off by the inner surface of the cover member 24. Thus, a conduction state between the conductive double-sided tape 58 and the first chassis 12 is secured.

As a result, since the conductive fillers in the respective adhesive layers are sufficiently brought into contact with each other, the conductive double-sided tape 58 is fixed to the metallic sheet 56 with a desired electrical conductivity, and the metallic plate 38 and the first chassis are electrically connected. The thickness of the conductive double-sided tape 58 may be set to, for example, less than 100% and more than or equal to 80% of the thickness of the double-sided tape. This is because if the conductive double-sided tape 58 is much thinner than the double-sided tape 50, the conductive double-sided tape 58 could instead not be sufficiently compressed and a desired electrical conductivity could not be obtained. It is to be noted that since a thickness ratio of the conductive double-sided tape to the double-sided tape 50 differs depending on the thickness of the double-sided tape 50 or a material of the conductive filler, it can be set to an optimum value according to each specification.

Figure 7:
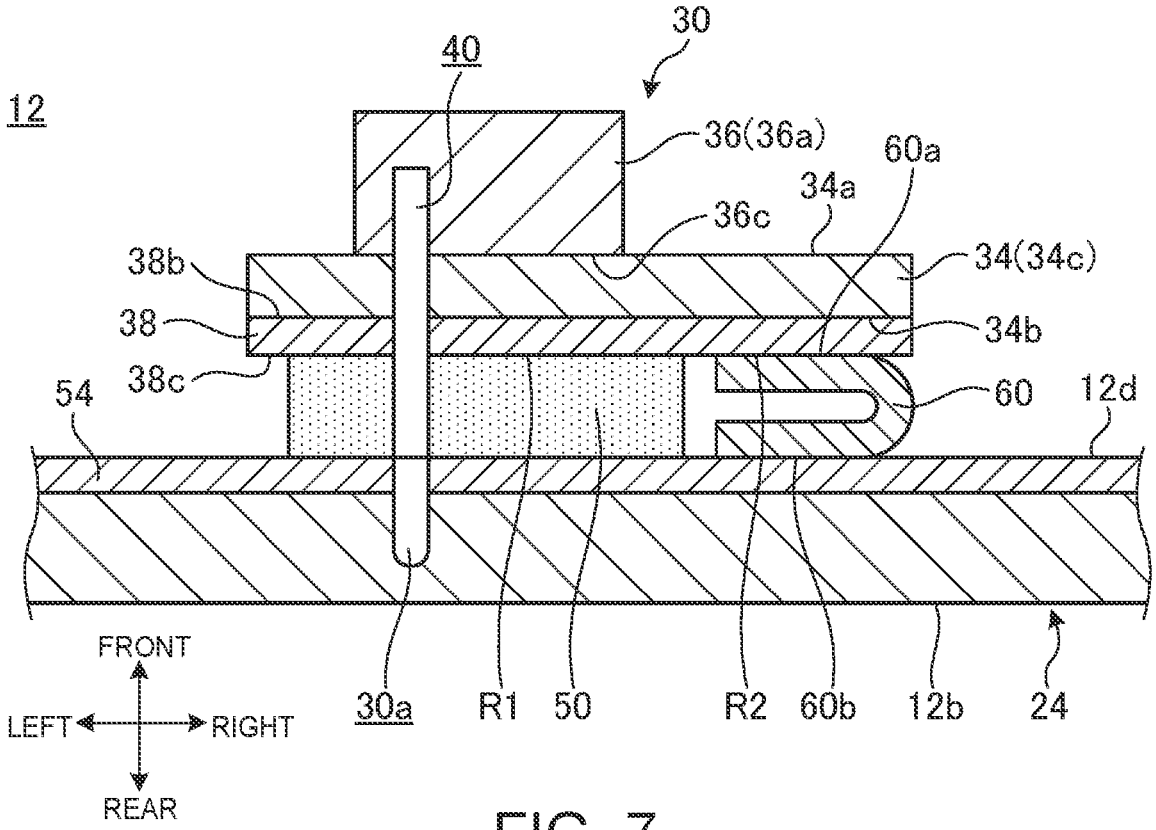
FIG. 7 is a schematic cross-sectional view in a state where the microphone module is attached to the first chassis using a conductive member according to a second variation.

FIG. 7 is a schematic cross-sectional view in a state where the microphone module 30 is attached to the first chassis 12 using a conductive member (metallic sheet 60) according to a second variation.

A configuration example as illustrated in FIG. 7 is different from that as illustrated in FIG. 5A in using the metallic sheet 60, instead of the conductive double-sided tape 52.

The metallic sheet 60 is a conductive member for electrically connecting the second region R2 of the back surface 38*c* of the metallic plate 38 and the inner surface 12*d* of the first chassis 12 (metal-deposited layer 54). The metallic sheet 60 is a thin sheet that is made of metal such as aluminum and copper. The metallic sheet 60 is installed, for example, in a state of being folded into a U-shape, on its side between the back surface 38*c* and the inner surface 12*d*. One end part (first end part 60*a*) of the U-shape of the metallic sheet 60 is fastened to the back surface 38*c* of the metallic plate 38 using an adhesive or a sticky agent. The other end part (second end part 60*b*) of the U-shape of the metallic sheet 60 is fastened to the inner surface 12*d* of the first chassis 12 (metal-deposited layer 54) using an adhesive or a sticky agent.

The metallic sheet 60 may be, for example, bent in a staircase shape without being folded in the U-shape, to be fixed to the back surface 38*c* and the inner surface 12*d*. However, since the first end part 60*a* and the second end part 60*b* are arranged in the right-and-left direction in this configuration, a right-and-left directional width of the microphone module 30 must be enlarged when the end parts 60*a* and 60*b* are intended to be fixed to the surfaces 38*c* and 12*d* with a sufficient contact area. In this regard, by folding the metallic sheet 60 into the U-shape as described above, the end parts 60*a* and 60*b* can be fixed to the surfaces 38*c* and 12*d* with a sufficient contact area, although its installation area is minimized in plan view. It is to be noted that also when the microphone module 30 of the configuration example as illustrated in FIG. 7 is fixed to the inner surface 12*d* of the first chassis 12, the double-sided tape 50 and the folded metallic sheet 60 may be compressed toward the inner surface 12*d*.

Figure 8A:
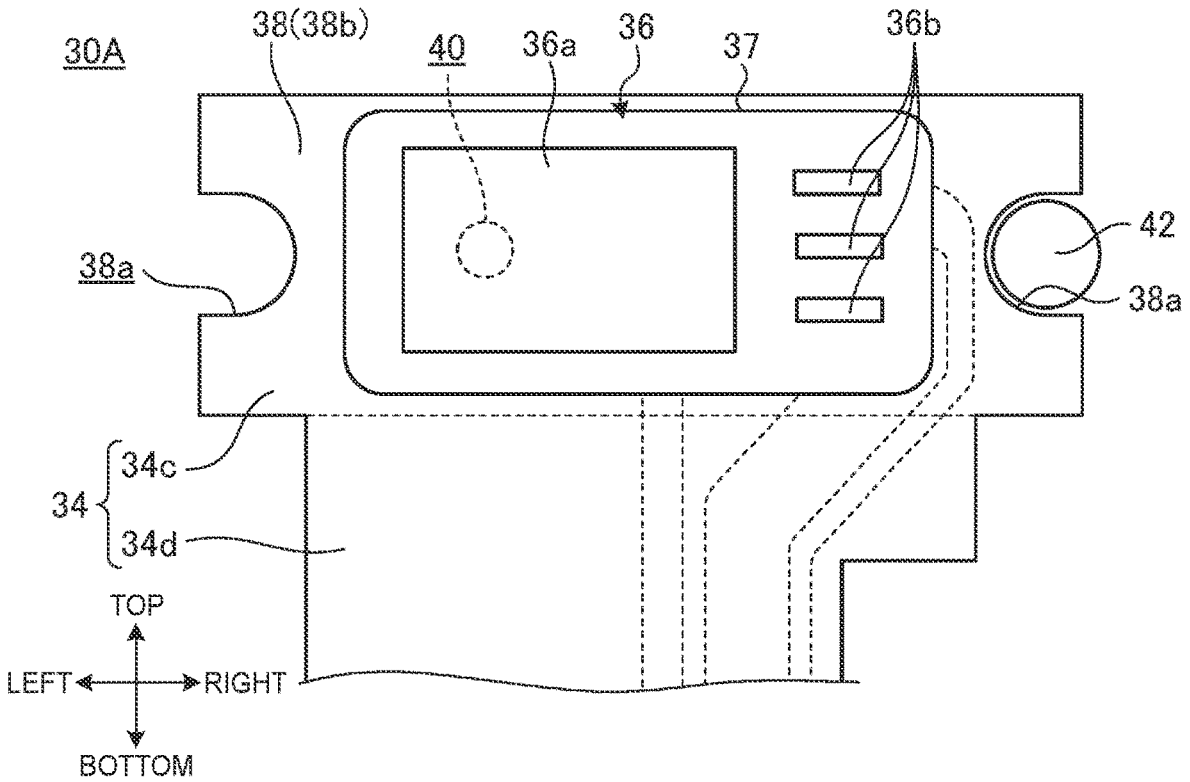
FIG. 8A is a schematic plan view of a microphone module according to a variation as viewed from the front surface side.
Figure 8B:
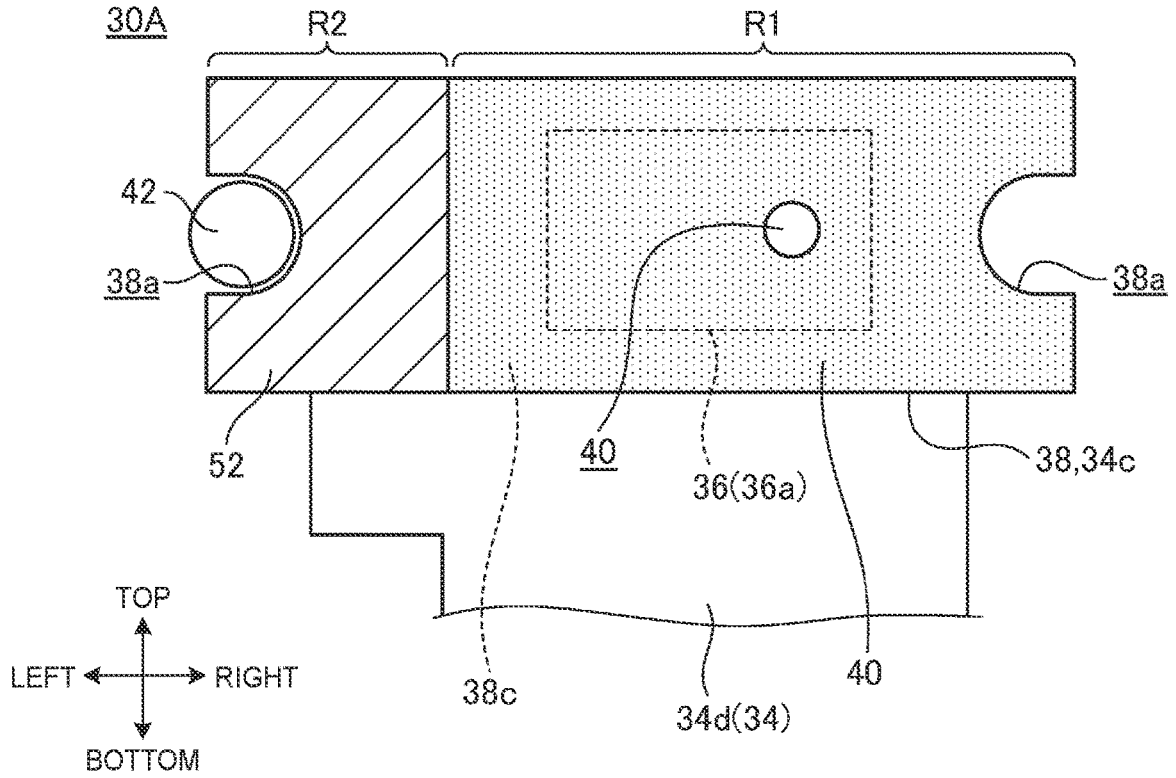
FIG. 8B is a schematic bottom view of the microphone module illustrated in FIG. 8A as viewed from the rear surface side.

FIG. 8A is a schematic plan view of the microphone module 30A according to a variation as viewed from the front surface 12*a* side. FIG. 8B is a schematic bottom view of the microphone module 30A as illustrated in FIG. 8A as viewed from the rear surface 12*b* side.

The microphone module 30A as illustrated in FIG. 8A and FIG. 8B is configured to have a right-and-left directional width of the entire module shorter than that of the microphone module 30 as illustrated in FIG. 3A and FIG. 3B etc.

In the microphone module 30 as illustrated in FIG. 3A and FIG. 3B etc., the right-and-left directional width of the entire module is formed long to some extent in relation to the arrangement of the positioning pin 42 of the first chassis 12. On the other hand, the microphone module 30A as illustrated in FIG. 8A and FIG. 8B is structured so that the right-and-left directional width of the metallic plate 38 and the microphone-mounting part 34*c* (flexible substrate 34) is reduced as much as possible to the same right-and-left directional width of the microphone 36. As is clear from FIG. 8A and FIG. 8B, in the microphone module 30A of a specification for which there is no need for positioning by the cutout part 38*a*, the right-and-left directional width of the microphone 36 and that of the metallic plate 38 etc. become substantially the same.

Also in the microphone module 30A, the double-sided tape 50 must surround the periphery of the sound hole 40 within a predetermined radius region. This is to ensure the air-tightness of the microphone 36. Such a microphone module 30A may be used in combination with the configuration examples as illustrated in FIG. 6 and FIG. 7.

Figure 9:
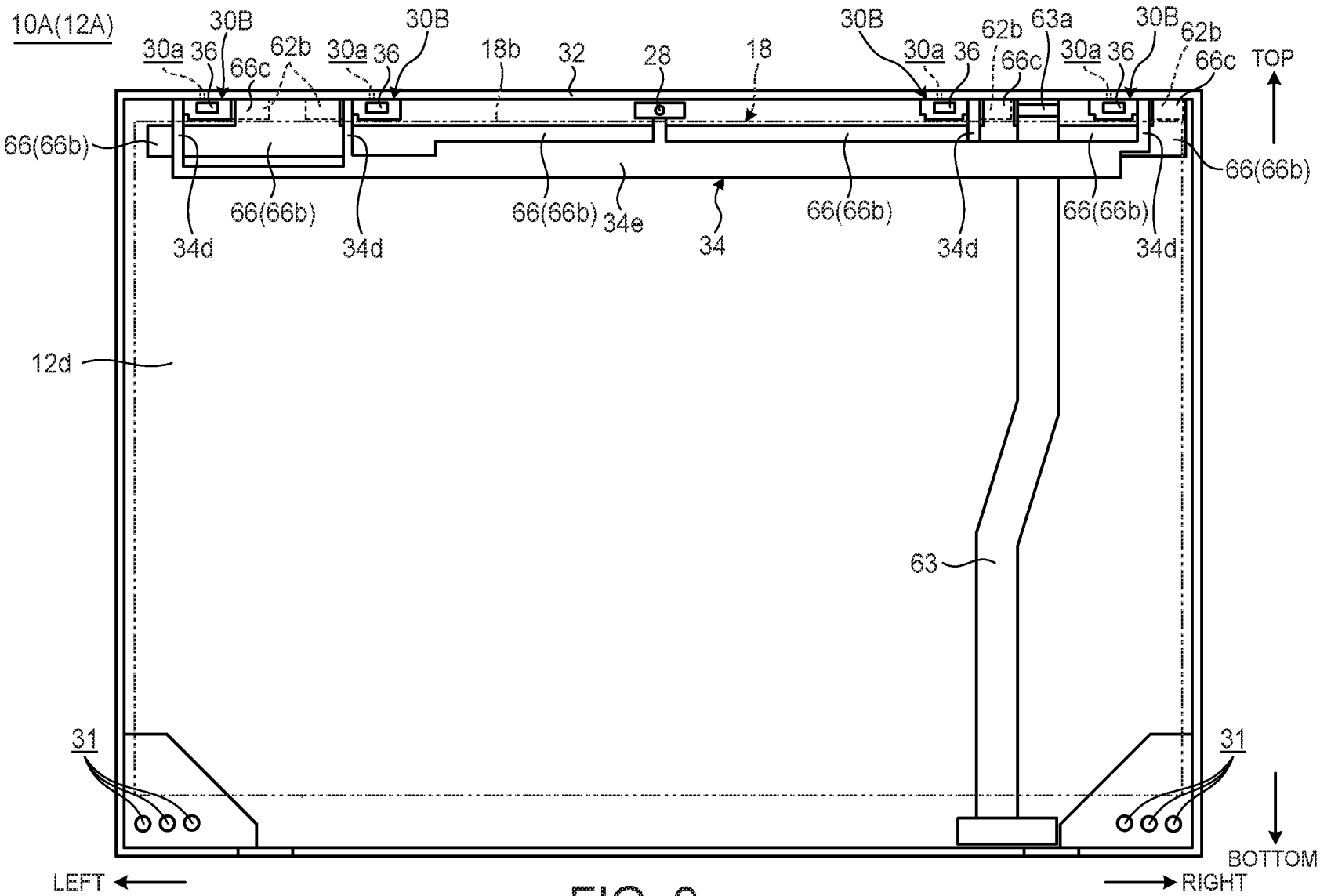
FIG. 9 is a schematic plan view of the first chassis of the electronic device according to a second embodiment as viewed from the front surface side.

FIG. 9 is a schematic plan view of the first chassis 12A of the electronic device 10A according to a second embodiment as viewed from the front surface 12*a* side. In the electronic device 10A, an element that exhibits a function and an effect the same as or similar to the configuration of the electronic device 10 according to the first embodiment is followed by the same reference symbol and its detailed description is omitted. The first chassis 12A and its internal components are described below. The overall configuration of the electronic device 10A and the configuration of the second chassis 14 may be the same as or similar to that of the electronic device 10 as illustrated in FIG. 1.

As illustrated in FIG. 9, the first chassis 12A of the electronic device 10A is also equipped with microphone modules 30B. For example, four microphone modules 30B are installed so as to be arranged right and left, and each obtains sound information outside the first chassis 12 through a microphone hole 30*a*. Each microphone module 30B is also arranged right and left above an outer peripheral end surface 18*b* on a top side of the display 18 and covered by the bezel member 26.

Next, a configuration of the microphone module 30B is described.

Figure 10A:
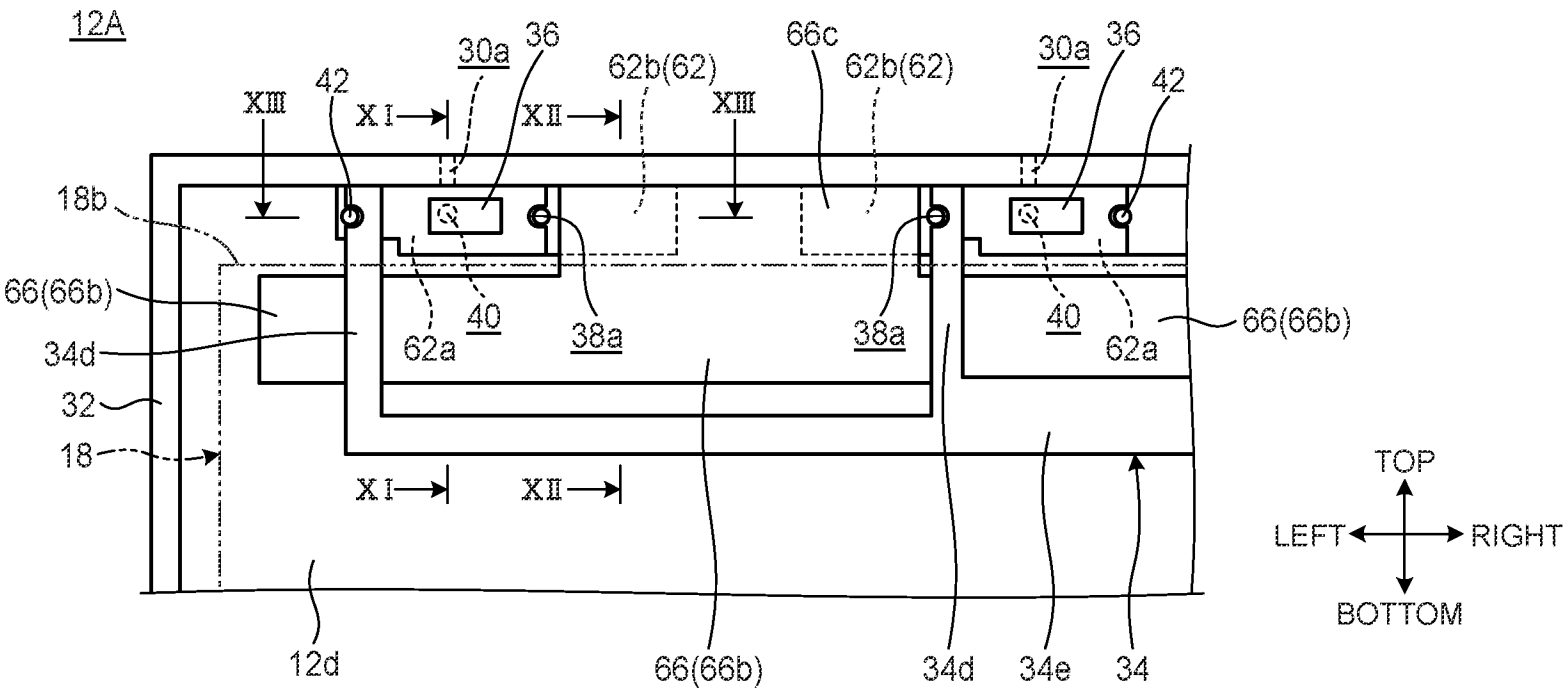
FIG. 10A is a schematic plan view enlarging a part of FIG. 9.
Figure 10B:
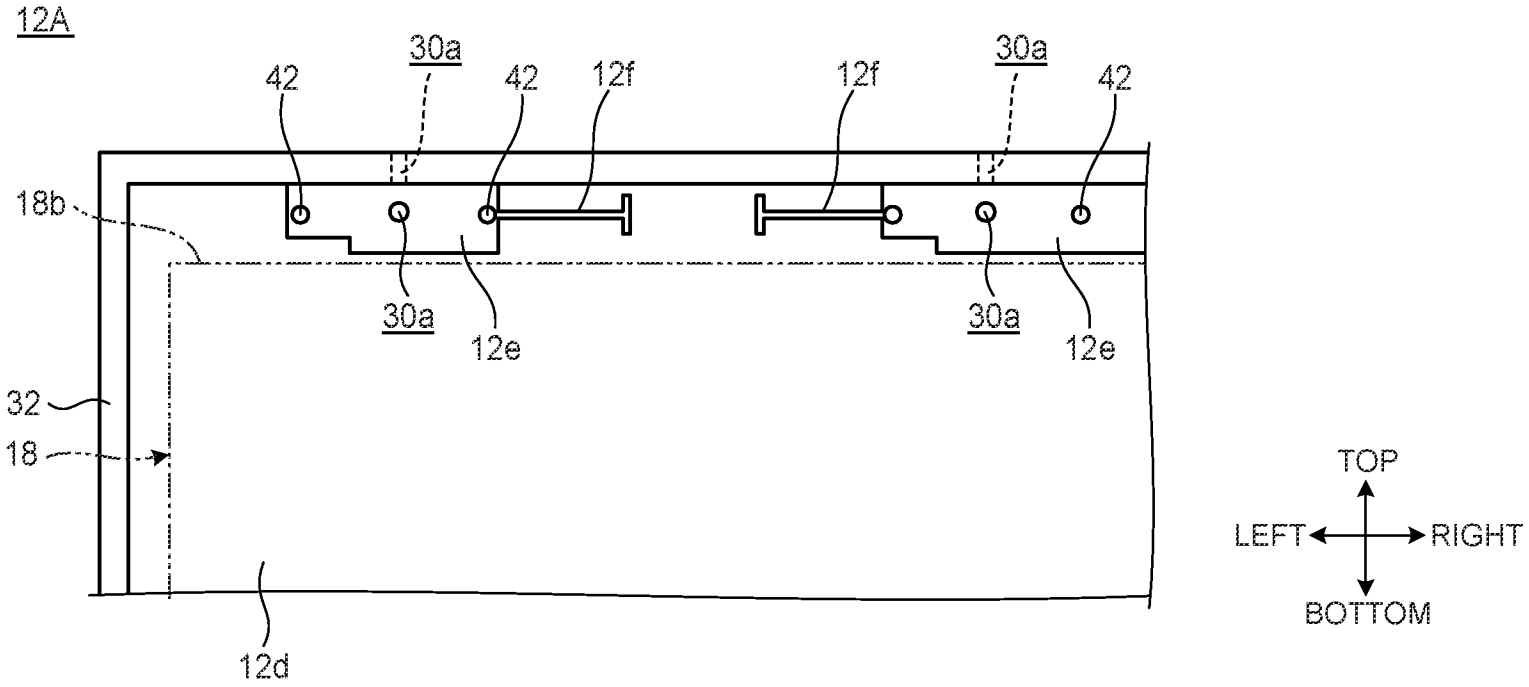
FIG. 10B is a view illustrating a state where a microphone module and a metallic sheet are removed from the first chassis as illustrated in FIG. 10A.
Figure 10C:
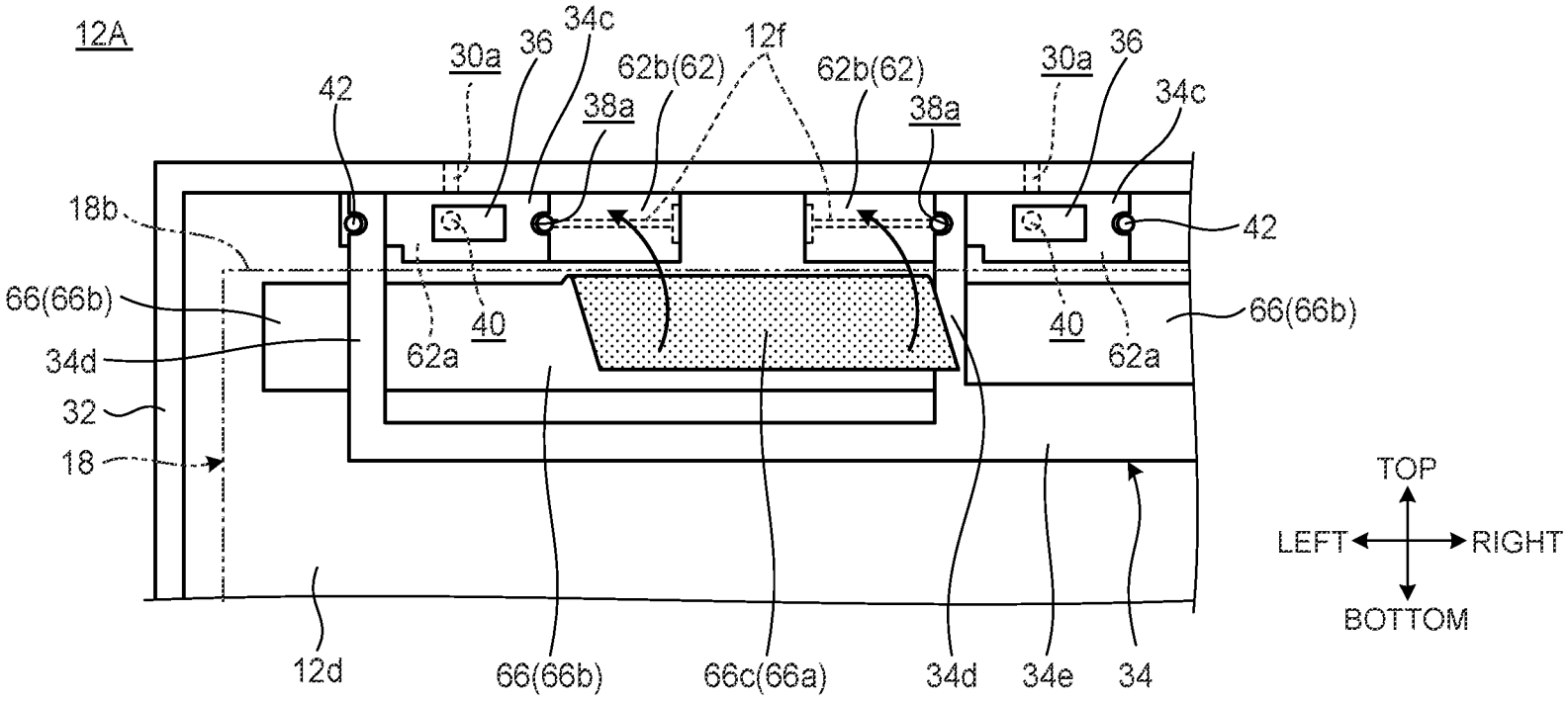
FIG. 10C is a view illustrating a state where the microphone module has been attached to the first chassis as illustrated in FIG. 10B and just before the metallic sheet is stuck onto a metallic plate.
Figure 11:
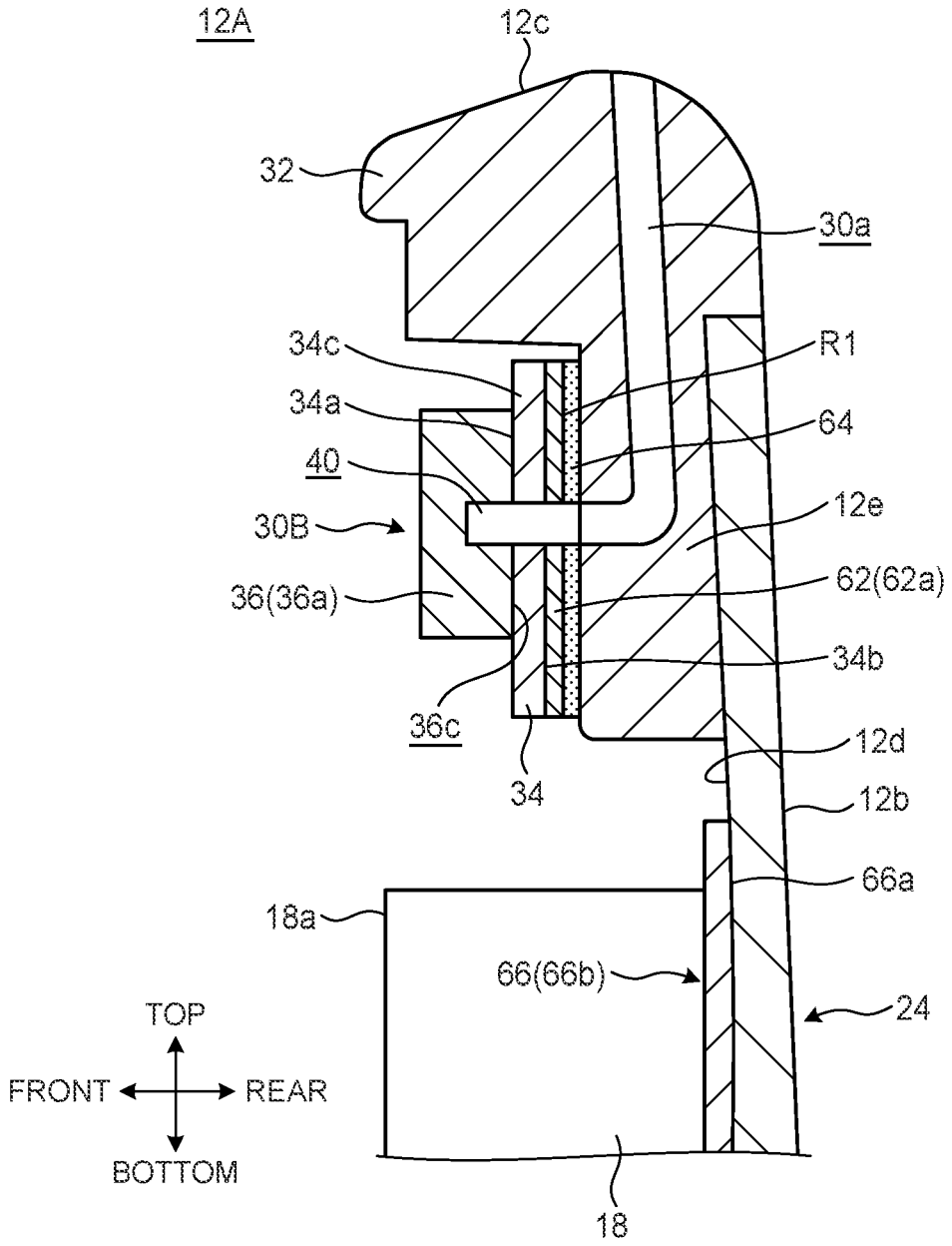
FIG. 11 is a schematic cross-sectional view along a XI-XI line in FIG. 10A.
Figure 12:
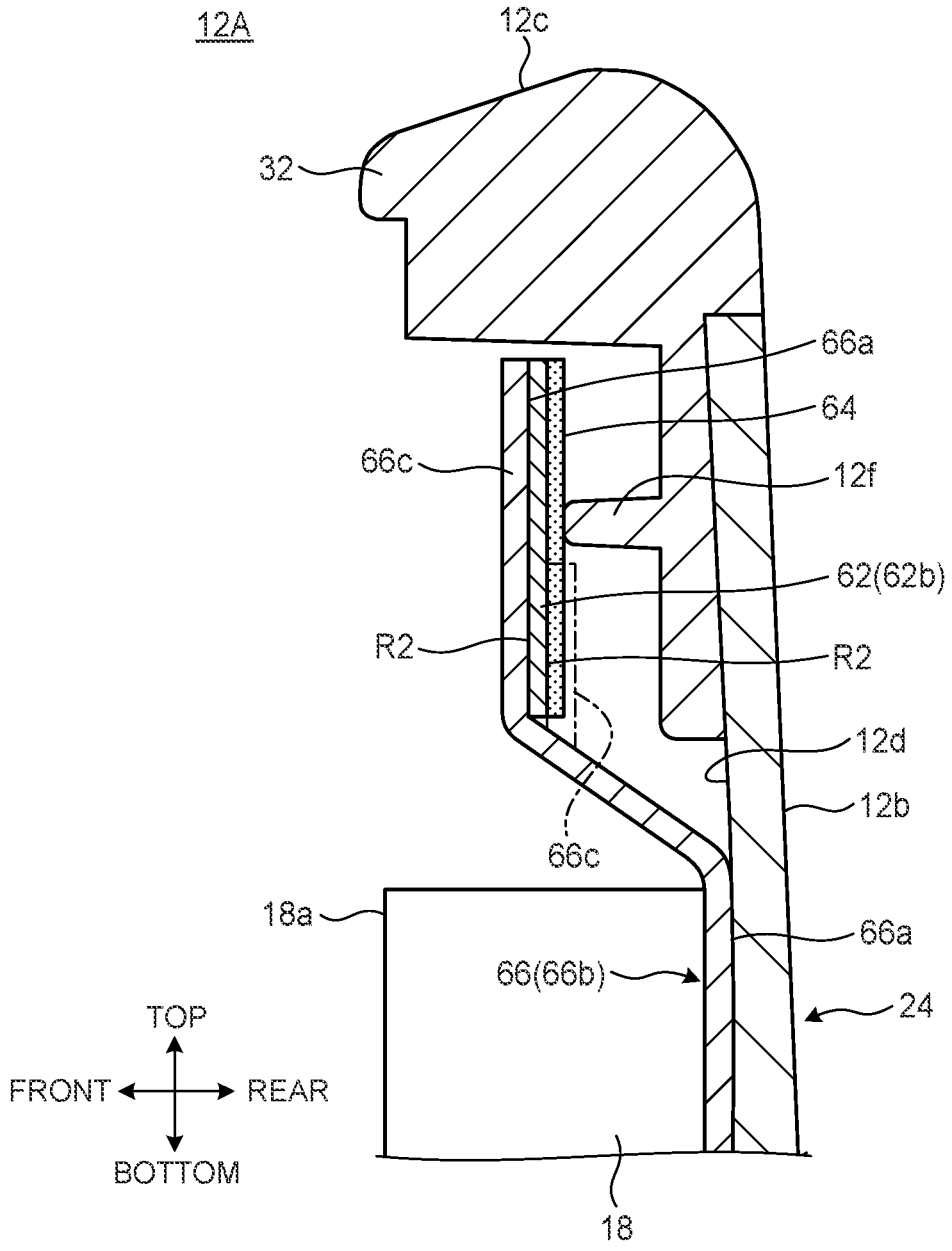
FIG. 12 is a schematic cross-sectional view along a XII-XII line in FIG. 10A.
Figure 13:
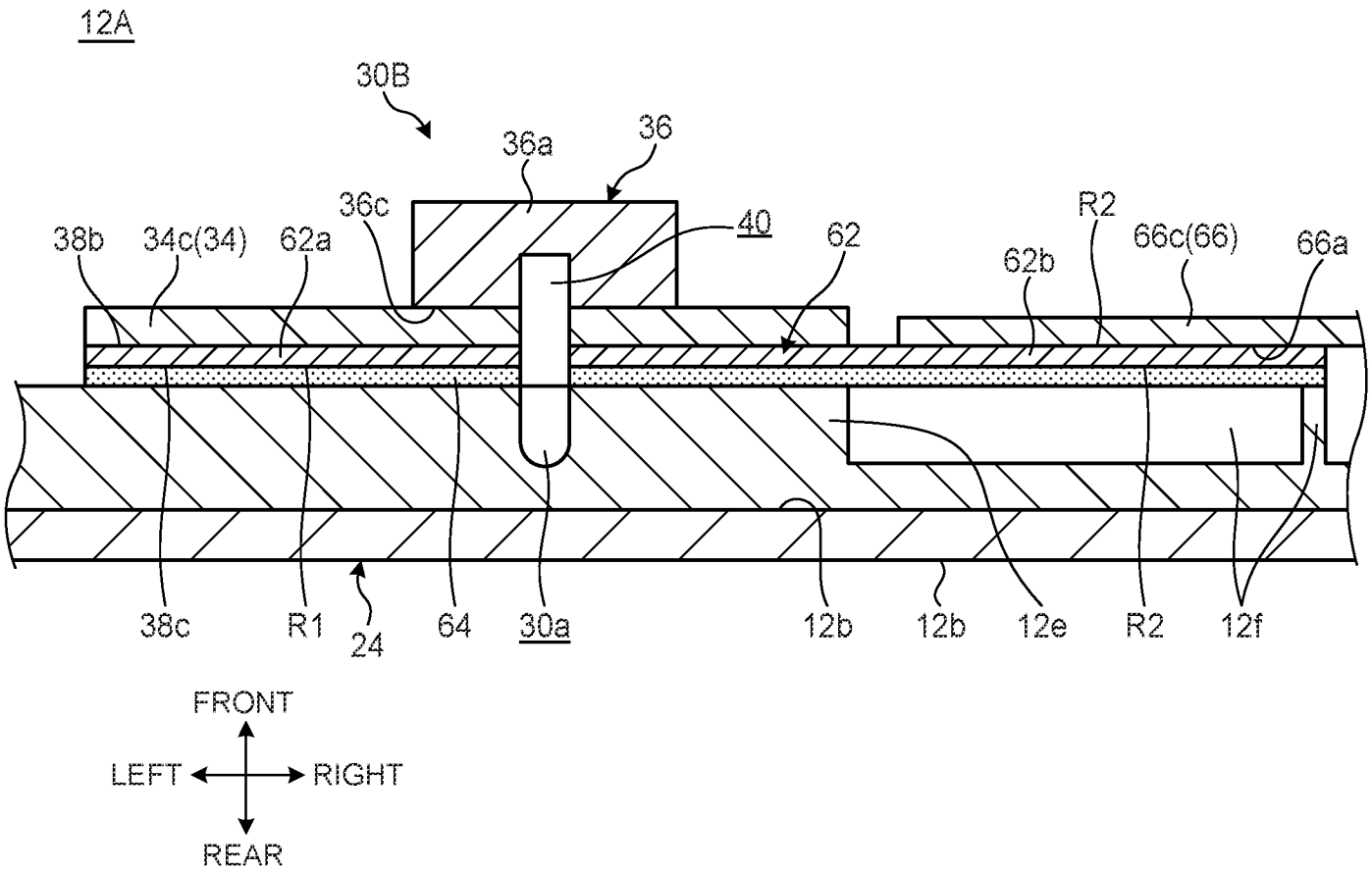
FIG. 13 is a schematic cross-sectional view along a XIII-XIII line in FIG. 10A.

FIG. 10A is a schematic plan view enlarging a part of FIG. 9. FIG. 10B is a view illustrating a state where the microphone modules 30B and a metallic sheet 66 are removed from the first chassis 12A as illustrated in FIG. 10A. FIG. 10C is a view illustrating a state where the microphone modules 30B have been attached to the first chassis 12A as illustrated in FIG. 10B and just before the metallic sheet 66 is stuck onto a metallic plate 62. FIG. 11 is a schematic cross-sectional view along a XI-XI line in FIG. 10A. FIG. 12 is a schematic cross-sectional view along a XII-XII line in FIG. 10A. FIG. 13 is a schematic cross-sectional view along a XIII-XIII line in FIG. 10A.

As illustrated in FIG. 10A and FIG. 13, each microphone module 30B includes the metallic plate 62 that is different in configuration from the above-described metallic plate 38 of the microphone module 30.

A microphone 36, flexible substrate 34, and sound hole that constitute the microphone module 30B have configurations the same as or similar to those of the microphone 36, flexible substrate 34, and sound hole 40 that constitute the above-described microphone module 30 (30A). Although illustration is omitted in FIG. 9 to FIG. 13, the microphone 36 of the microphone module 30B is also, for example, a MEMS microphone in which a MEMS chip 36*a* or an IC chip 36*b* is shielded by a polymer cover 37.

In a configuration example as illustrated in FIG. 9, the flexible substrate 34 is connected to a connector 63*a* that is disposed between the microphone modules 30B and 30B on the right. The connector 63*a* is connected to another flexible substrate 63 that is connected to a motherboard etc. in the second chassis 14. Also in the electronic device 10A, the flexible substrate 34 may be directly connected to the motherboard etc. On the other hand, the flexible substrate of the above-described electronic device 10 may be connected to the motherboard etc. via the flexible substrate 63.

A basic structure of the metallic plate 62 may be the same as or similar to that of the above-described metallic plate 38. That is, the metallic plate 62 is made of a conductive metal such as stainless steel, and is laminated on a back surface 34*b* of the flexible substrate 34. The metallic plate 62 has a width dimension in the top-and-bottom direction the same as or similar to that of the above-described metallic plate 38 but has a width dimension in the right-and-left direction significantly larger than that of the above-described metallic plate 38 (refer to FIG. 5A and FIG. 13).

As illustrated in FIG. 10C to FIG. 13, the metallic plate 62 has substrate fixing parts 62*a* and projecting parts 62*b*. In the second embodiment, one part of the metallic plate 62 formed of one plate is referred to as the substrate fixing part 62*a*, and the other part is referred to as the projecting part 62*b*. The substrate fixing part 62*a* is fixed to a back surface 34*b* of the microphone-mounting part 34*c* using an adhesive or a double-sided tape as with the above-described metallic plate 38 to reinforce the rigidity of the microphone module 30B. The projecting part 62*b* extends from the substrate fixing part 62*a* to one of right and left sides. The projecting part 62*b* projects from one of right and left outer edges of the microphone-mounting part 34*c* in one of right and left directions. In a state where the microphone module 30B is not attached to the first chassis 12A, at least the front surface 38*b* of the projecting part 62*b* is exposed to the external appearance of the microphone module 30B.

Next, a structure for attaching the microphone module 30B to the first chassis 12A is described.

As illustrated in FIG. 11 to FIG. 13, each microphone module 30B is attached to the first chassis 12A using a double-sided tape 64. The double-sided tape 64 may be the same as or similar to the above-described double-sided tape 50. The double-sided tape 64 fixes the back face 38*c* of the substrate fixing part 62*a* and the inner surface 12*d* of the first chassis 12A. The sound hole 40 is also penetratingly formed in the double-sided tape 64. In the case of the second embodiment, the double-sided tape 64 covers the entire back face 38*c* of the metallic plate 62, that is, from the substrate fixing part 62*a* up to the projecting part 62*b*. The double-sided tape 64 must only be provided at least at a partial region (first region R1), surrounding the sound hole 40, of the back surface 38*c* of the metallic plate 62.

As illustrated in FIG. 10B, and FIG. 11 to FIG. 13, a microphone stand 12*e* and a support bridge 12*f* protrude from the inner surface 12*d* of the first chassis 12A. The microphone stand 12*e* is an elevation on which the microphone module 30B is installed. The microphone hole 30*a* penetrates through the vertical wall 32 from this microphone stand 12*e*. The microphone stand 12*e* is provided above the outer peripheral end surface 18*b* of the display 18 in the inner surface 12*d*, and extends in the right-and-left direction. The microphone stand 12*e* has an outline substantially the same as that of the substrate fixing part 62*a* or the microphone-mounting part 34*c* in plan view. In the microphone module 30B, the back surface 38*c* of the substrate fixing part 62*a* is fixed to the surface of the microphone stand 12*e* using the double-sided tape 64. The microphone module 30B may also be directly installed on the inner surface 12*d* as with the configuration example as illustrated in FIG. 4. On the other hand, the above-described microphone modules 30 and 30A may be installed using the microphone stand 12*e*.

The support bridge 12*f* is a part that supports the projecting part 62*b* of the metallic plate 62. The support bridge 12*f* is, for example, formed into a substantially T shape in plan view. The support bridge 12*f* protrudes from one of right and left ends of the microphone stand 12*e* in one of right and left directions. A height of the support bridge 12*f* is the same as that of the microphone stand 12*e*. The projecting part 62*b* abuts against a surface of the support bridge 12*f* across the double-sided tape 64. With this, the projecting part 62*b* is positioned at the same height position as the substrate fixing part 62*a* and stabilized. The support bridge 12*f* may be replaced by extension of the microphone stand 12*e*. The double-sided tape 64 on the back surface 38*c* of the projecting part 62*b* may be omitted by forming the support bridge 12*f* to be higher by the thickness of the double-sided tape 64 than the microphone stand 12*e*.

As illustrated in FIG. 9, the metallic sheet 66 is provided on the inner surface 12*d* of the first chassis 12A. The metallic sheet 66 is a conductive member that is provided in place of the above-described metal-deposited layer 54 or metallic sheet 56 and the conductive double-sided tapes 52 and 58 or metallic sheet 60. The metallic sheet 66 is a belt-shaped sheet that is stuck to the inner surface 12*d* of the first chassis 12A and extends over the right-and-left direction of the first chassis 12A. The metallic sheet 66 is a thin sheet that is made of metal with high electrical conductivity, such as aluminum or copper. The metallic sheet 66 may have, for example, a wide square shape, or a narrow wire shape, other than the belt shape as described above. The above-described metallic sheets 56 and 60 can be formed into various shapes, as with the metallic sheet 66.

The metallic sheet 66 has an adhesive tape structure in which an adhesive is provided on its back surface 66*a*. As illustrated in FIG. 9 and FIG. 10C, a belt-shaped part 66*b* extending in the right-and-left direction and constituting most of the metallic sheet 66 is adhered to the inner surface 12*d*. The metallic sheet 66 has finny sticking parts 66*c* that protrude upward, at respective locations of this belt-shaped part. The sticking part 66*c* is provided at a position crossing the projecting part 62*b* of each microphone module 30B in the top-and-bottom direction. The sticking part 66*c* is adhesively fixed to the front surface 38*b* from the front side so as to cover the projecting part 62*b* of the metallic plate 62 (refer to FIG. 12 and FIG. 13).

Thus, the sticking part 66*c* is connected to the second region R2, except the first region R1, of the metallic plate 62. This second region R2 is a region that does not cross the sound hole 40, and includes, for example, both surfaces 38*b* and 38*c* of the projecting part 62*b* of the metallic plate 62. In the second embodiment, a configuration in which the sticking part 66*c* is connected to the second region R2 on the front surface 38*b* side, is illustrated as an example. The sticking part 66*c* may be connected to the second region R2 on the back surface 38*c* side (refer to the sticking part 66*c* as indicated by a dashed-two dotted line in FIG. 12).

One example of an attaching method of the microphone module 30B is described. The first chassis 12A is in a state as illustrated in FIG. 10B, before the microphone module 30B and the metallic sheet 66 are attached thereto. From this state, the belt-shaped part 66*b* of the metallic sheet 66 excluding the sticking part 66*c* is stuck onto the inner surface 12*d*. Then, as illustrated in FIG. 10C, the sticking part 66*c* of the metallic sheet 66 is folded back from the border with the belt-shaped part 66*b* to the bottom side, and the microphone module 30B is attached. Finally, as illustrated in FIG. 10A, the sticking part 66*c* is returned to the top side and stuck onto the front surface 38*b* of the projecting part 62*b*. As such the attaching work of the microphone module 30B is completed.

As described above, the electronic devices 10 and 10A according to the above-described embodiments include the double-sided tapes 50 and 64 that are fastened to the first region R1, surrounding the sound hole 40, of the back surface 38*c* of the metallic plates 38 and 62 constituting the microphone modules 30 (30A) and 30B and to the inner surface 12*d* of the first chassis 12, and fix the microphone modules (30A) and 30B to the first chassis 12 and 12A. Further, the electronic devices 10 and 10A include the conductive member (conductive double-sided tapes 52, 58, metallic sheet 60, or metallic sheet 66) that electrically connects the second region R2, except the first region R1, of the metallic plates 38 and 62 and the inner surface 12*d* of the first chassis 12 and 12A.

Therefore, according to the electronic devices 10 and 10A, it is possible to ensure high air-tightness by fixing the microphone modules 30 (30A) and 30B to the inner surface 12*d* with high adhesive power by the double-sided tapes 50 and surrounding the sound hole 40. In addition, the microphone modules 30, 30A, and 30B eliminate the need for a mounting screw and a space for fastening it. Thus, the microphone modules 30, 30A, and 30B can be installed in a reduced space, and they can be surely installed in, for example, a narrow bezel space between the outer peripheral end surface 18*b* of the display 18 and the vertical wall 32. Furthermore, the microphone modules 30, 30A, and 30B can also surely secure the frame ground by the conductive member (conductive double-sided tapes 52, 58, metallic sheet 60, or metallic sheet 66).

The conductive member (conductive double-sided tape 52 etc.) for frame ground of the microphone module 30 (30A) according to the first embodiment is installed at a position sandwiched between the back surface 38*c* of the metallic plate 38 and the inner surface 12*d* of the first chassis 12. Thus, an outline area of the microphone module 30 (30A) in planar view can be minimized while the frame ground is surely secured, and space-saving, in particular, in the right-and-left direction is possible. As a result, while the right-and-left directional width of the microphone module 30 (30A) is configured to be, for example, substantially the same as that of the microphone element (microphone 36) (refer to FIG. 8A and FIG. 8B), the air-tightness and frame ground are secured. In particular, the electronic device 10 may have a significant space constraint since an LED module for a so-called smart light or various types of sensors etc. as well as the camera 28 are installed in an installation space for the microphone module 30 (30A), as illustrated in FIG. 2. However, since the right-and-left directional width of the microphone module 30 (30A) can be reduced to the limit, a four-microphone structure as illustrated in FIG. 2 can also be easily constructed.

On the other hand, the conductive member (metallic sheet 66) for frame ground of the microphone module 30B according to the second embodiment is installed across the projecting part 62*b* resulting from extending the metallic plate 62 and inner surface 12*d* of the first chassis 12. The dimension of the microphone module 30B in the right-and-left direction is larger by the projecting part 62*b* than that of the above-described microphone modules 30 and 30A. However, the microphone module 30B is configured to stick the metallic sheet 66 onto the projecting part 62*b* protruded and exposed from the flexible substrate 34. Therefore, in the microphone module 30B, the conductive member (metallic sheet 66) does not stretch between the back surface 38*c* of the metallic plate 62 and the inner surface 12*d* of the first chassis 12A, unlike in the case of the microphone modules 30 and 30A according to the first embodiment. Thus, the microphone module 30B makes control of the thickness between the double-sided tape 50 and the conductive double-sided tape 52 taken in the microphone modules 30 and 30A unnecessary. That is, the microphone module 30B does not cause degradation in air-tightness due to variation in thickness of the conductive double-sided tape 52. Thus, the microphone module 30B is easy to manufacture and mount and can reduce manufacturing cost and cost of mounting work. In addition, the microphone module 30B eliminates the need for cost of forming the metal-deposited layer 54 since the metallic sheet 66 stuck to the inner surface 12*d* is directly stuck to the metallic plate 62. The microphone module 30B also has an advantage of easily securing a large adhesive area of the double-sided tape 64 since the conductive double-sided tape 52 etc. is not disposed under the metallic plate 62.

It is to be noted that the metallic plate 62 extends in a gap between the outer peripheral end surface 18*b* of the display 18 and the outer wall (vertical wall 32) along the outer peripheral end surface 18*b* in the right-and-left direction. Thus, the influence of erosion of the inner space of the first chassis 12A due to provision of the projecting part 62*b* is minimal, and the reduction in width of the bezel member 26 is not prevented.

As described above, the metallic sheet 66 may be stuck onto the front surface 38*b* of the projecting part 62*b* or may be stuck onto the back surface 38*c*. However, when the metallic sheet 66 is stuck onto the back surface 38*c* side, it is necessary to control so as not to influence the air-tightness by the double-sided tape 64. Since the metallic sheet 66 has an adhesive layer on its back surface 66*a* in the first place, it is more efficient to stick this directly onto the front surface 38*b*.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

10, 10A electronic device
12, 12A first chassis
14 second chassis
16 hinge
18 display
30, 30A, 30B microphone module
30*a* microphone hole
34, 63 flexible substrate
36 microphone
38, 62 metallic plate
40 sound hole
50, 64 double-sided tape
52, 58 conductive double-sided tape
56, 60, 66 metallic sheet

What is claimed is:

1. An electronic device comprising:
a chassis;
a microphone hole that penetrates an outer wall of the chassis and communicates an inside and an outside of the chassis; and
a microphone module provided in the chassis and disposed so as to face the microphone hole, wherein
the microphone module has:
a microphone that obtains sound information outside the chassis through the microphone hole;
a flexible substrate laminated on a back surface of the microphone and mounted with the microphone;
a metallic plate laminated on a back surface of the flexible substrate; and
a sound hole opened in the back surface of the microphone and penetrating the flexible substrate and the metallic plate, and
the electronic device further comprises:
a double-sided tape fastened to a first region, surrounding the sound hole, of a back surface of the metallic plate, and to an inner surface of the chassis, and that fixes the microphone module to the chassis; and
a conductive member that electrically connects a second region, except the first region, of the metallic plate and the inner surface of the chassis.

2. The electronic device according to claim 1, wherein
the metallic plate has a projecting part that projects from an outer edge of the flexible substrate, and
the conductive member is connected between a front surface of the projecting part and the inner surface of the chassis.

3. The electronic device according to claim 2, wherein the conductive member is composed of a metallic sheet stuck both to the front surface of the projecting part and to the inner surface of the chassis.

4. The electronic device according to claim 2, further comprising:
a display mounted on the chassis, wherein
the microphone module is disposed between an outer peripheral end surface of the display and the outer wall of the chassis, and
the metallic plate extends along the outer peripheral end surface of the display.

5. An electronic device comprising:
a chassis;
a microphone hole penetrating an outer wall of the chassis and communicating an inside and an outside of the chassis; and
a microphone module provided in the chassis and disposed so as to face the microphone hole, wherein
the microphone module has:
a microphone that obtains sound information outside the chassis through the microphone hole;
a flexible substrate laminated on a back surface of the microphone and mounted with the microphone;
a metallic plate laminated on a back surface of the flexible substrate; and
a sound hole opened in the back surface of the microphone and penetrating the flexible substrate and the metallic plate, and
the electronic device further comprises:
a double-sided tape fastened to a first region, surrounding the sound hole, of a back surface of the metallic plate, and to an inner surface of the chassis, and that fixes the microphone module to the chassis; and
a conductive member installed between a second region, except the first region, of the back surface of the metallic plate, and the inner surface of the chassis, and that electrically connects the second region and the inner surface of the chassis.

6. The electronic device according to claim 5, wherein
the conductive member is a conductive double-sided tape whose thickness is thicker than the double-sided tape, and
the conductive double-sided tape is compressed to be installed between the second region and the inner surface of the chassis.

7. The electronic device according to claim 6, wherein
the conductive member is a conductive double-sided tape whose thickness is thicker than the double-sided tape and less than or equal to 110% of the thickness of the double-sided tape, and
the conductive double-sided tape is compressed to be installed between the second region and the inner surface of the chassis.

8. The electronic device according to claim 5, wherein the conductive member is composed of a conductive double-sided tape whose thickness is thinner than the double-sided tape, a metallic sheet is stuck to the inner surface of the chassis, and the metallic sheet has a non-adhesive region not to be stuck to the inner surface of the chassis in a range overlapping the conductive double-sided tape.

9. The electronic device according to claim 5, wherein the conductive member is composed of a metallic sheet fastened both to the back surface of the metallic plate and to the inner surface of the chassis.

10. The electronic device according to claim 9, wherein the metallic sheet has, in a state of being folded into a U-shape, one end part of the U-shape fastened to the back surface of the metallic plate and another end part of the U-shape fastened to the inner surface of the chassis.

* * * * *